US007123870B2

(12) United States Patent
Kyung et al.

(10) Patent No.: US 7,123,870 B2
(45) Date of Patent: Oct. 17, 2006

(54) INTERMEDIATE TRANSFER BELT OF IMAGE FORMING APPARATUS FOR SENDING INITIAL PRINTING POSITION, APPARATUS USING THE IMAGE TRANSFER BELT, AND METHOD THEREOF

(75) Inventors: Myung-ho Kyung, Suwon (KR); Moon-bae Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 257 days.

(21) Appl. No.: 10/706,955

(22) Filed: Nov. 14, 2003

(65) Prior Publication Data

US 2004/0146321 A1 Jul. 29, 2004

(30) Foreign Application Priority Data

Jan. 25, 2003 (KR) ..... 10-2003-0005080

(51) Int. Cl.
*G03G 15/01* (2006.01)
*G03G 15/16* (2006.01)

(52) U.S. Cl. ..... 399/302; 399/66

(58) Field of Classification Search ..... None
See application file for complete search history.

(56) References Cited

U.S. PATENT DOCUMENTS 5,121,145 A * 6/1992 Buch et al. ..... 347/118
5,208,633 A * 5/1993 Genovese ..... 399/162
5,995,794 A * 11/1999 Osada et al. ..... 399/302
6,336,025 B1 * 1/2002 Saeki ..... 399/301

FOREIGN PATENT DOCUMENTS

JP 04345457 A * 12/1992
JP 05035124 A * 2/1993
JP 11077845 A * 3/1999
JP 11-231682 8/1999
JP 11249449 A * 9/1999
JP 2000-310897 11/2000
JP 2001350348 A * 12/2001

* cited by examiner

*Primary Examiner*—Robert Beatty
(74) *Attorney, Agent, or Firm*—Staas & Halsey LLP

(57) ABSTRACT

An transfer belt for use in an image forming apparatus that senses an initial printing position. The belt includes a PC alloy portion, protective tape, and an error prevention section. The PC alloy portion includes a position sensing hole extending therethrough and disposed proximate to an edge of the PC alloy portion. The PC alloy portion is usable to determine an initial printing position. The protective tape is attached to upper sides and lower sides of both edges of the PC alloy portion. The error prevention section is insertable into the position sensing hole and has a thickness substantially equivalent to the PC alloy located around the position sensing hole.

14 Claims, 6 Drawing Sheets

INTERMEDIATE TRANSFER BELT OF IMAGE FORMING APPARATUS FOR SENDING INITIAL PRINTING POSITION, APPARATUS USING THE IMAGE TRANSFER BELT, AND METHOD THEREOF

CROSS-REFERENCE TO RELATED APPLICATIONS

This application claims the benefit of Korean Application No. 2003-5080, filed Jan. 25, 2003, in the Korean Intellectual Property Office, the disclosure of which is incorporated herein by reference.

BACKGROUND OF THE INVENTION

1. Field of the Invention

The present invention generally relates to an image forming apparatus, and more particularly, to a transfer belt of an image forming apparatus for sensing an initial printing position without an error.

2. Description of the Related Art

As shown in FIG. 1, a typical image forming apparatus comprises an exposure unit 12 for generating laser beam, a photosensitive medium 21 on which electrostatic latent image is formed, a development unit 31 for supplying a developer to the photosensitive medium 21 to form visible image, a transfer unit 41 for transferring the visible image of the photosensitive medium 21 to printing paper P, and a fixing unit 51 for fixing the visible image to the printing paper P. The transfer unit 41 includes a transfer belt unit 42, a first transfer roller 43 and a second transfer roller 44. Additionally, the transfer belt unit 42 includes a transfer belt that serves as the transporting medium for the visible image and a plurality of rollers 46 supporting the transfer belt.

In the image forming apparatus having the configuration described above, an electrostatic latent image is formed on the surface of the photosensitive medium 21 when the photosensitive medium 21 charged with a certain potential and is irradiated with laser beam. Thereafter, a visible image is formed when developer supplied from the development unit 31 is applied to an image forming portion of the electrostatic latent image, the visible image is transported to the transfer belt, and transferred to the printing paper P. Finally, the visible image is fixed on the printing paper P by the fixing unit 51.

In such a printing operation, the transfer process is an important procedure which may affect the print quality, and the timing of forming the electrostatic latent image on the photosensitive medium should be synchronized with the transfer belt, because the electrostatic latent image on the photosensitive medium should be sequentially transported to the transfer belt without color unbalance before it is transferred to the printing paper P, thereby performing the printing.

Accordingly, by sensing a certain position of the intermediate transfer belt with a sensor and using this position as the criterion to determine when the electrostatic latent image should be formed on the photosensitive medium, the initial printing position of each color may be more accurately determined.

Conventionally, the initial printing position has been determined by sensing the tip of a position sensing hole in the transfer belt as shown in FIG. 2.

FIG. 2 is an elevation view of the intermediate transfer belt provided with a position sensing hole 11. FIG. 3 is a cross-sectional view of the transfer belt shown in FIG. 2, with the polycarbonate alloy 10 (hereinafter, to be referred to as PC alloy) of the intermediate transfer belt being formed with a position sensing hole 11 at one edge and tape 20 being attached to an upper side and a lower side at both edges of the PC alloy 10 so as to protect both edges of the PC alloy 10.

FIG. 4 is a cross-sectional view showing a position sensor 30 and a portion of the transfer belt having the position sensing hole 11. As shown in this figure, a portion of PC alloy 10 moves over a guide rail 40. The protective tape 20 is attached to the transfer belt on its upper and lower sides at both ends, although only one end is shown. When in motion, a portion of the transfer belt near an edge travels through the position sensor 30 and the position sensing hole 11 passes through the position sensor 30, the position sensor 30 senses the tip of the position sensing hole 11 and outputs the sensed signal. An image forming apparatus may use this outputted signal to determine the appropriate initial printing position for each color.

Since the position sensing hole 11 is formed by penetrating the PC alloy 10 (i.e., a throughhole), the segments of protective tape on the upper and lower sides of the transfer belt tend to stick to each other in the position sensing hole 11. However, due to the thickness (about 0.15 mm) of PC alloy 10, the tape segments do not stick together entirely. As a result, the position sensing hole 11 may be opaque. Additionally, when the segments of protective tape are continuously used, they tend to peel off at the attachment portion, and hence it is impossible to keep the section of the position sensing hole 11 transparent. Accordingly, the section of the position sensing hole 11 becomes to be opaque, thereby causing sensing errors in the sensing operations of the position sensor 30.

FIG. 5 shows another conventional transfer belt in which the PC alloy 10 is covered with the protective tape 20 on the upper and lower sides at both edges but in which the protective tape covering the hole 11 is removed so that the hole 11 is open. This arrangement does not suffer from the disadvantages of opacity described above. However, when the tape over the hole is removed as shown in FIG. 5, toner particles may enter and pass through the hole in the transfer belt and contaminate the drive roller (not shown). When an intermediate transfer belt unit is contaminated in this way, the belt slips and, as a result, is difficult to drive the transfer belt at the desired speed.

SUMMARY OF THE INVENTION

Therefore, the present invention is made in order to overcome the above and/or other problems.

It is an aspect of the present invention to provide a transfer belt of an image forming apparatus usable to sense an initial printing position, wherein the transfer belt is used to sense the initial printing position of the image forming apparatus that prints full colors using the transfer belt and exhibits an extended lifetime of the transfer belt while preventing errors from occurring in sensing the position by stably attaching the protective tape protecting the transfer belt.

Additional aspects and/or advantages of the invention will be set forth in part in the description which follows and, in part, will be obvious from the description, or may be learned by practice of the invention.

In order to accomplish the above object, according to one aspect of the present invention, there is provided a transfer belt of an image forming apparatus capable of sensing the initial printing position according to the present invention comprises PC alloy, including a position sensing hole penetratingly formed to sense initial printing position, for transferring a color image to form a composite color image; a protective tape that is attached to upper sides and lower sides of both ends of the PC alloy; and a error prevention section that is formed to be inserted in the position sensing hole by a thickness equivalent to the PC alloy and is located in the position sensing hole.

The error prevention section may be a transparent sheet. Additionally, the error prevention section may comprise a transparent portion and an opaque portion having a pattern corresponding to the position sensing signal to be transmitted.

According to another aspect of the present invention, there is provided an image forming apparatus including: a photosensitive drum onto which a latent image is formable; a developer unit which forms a visible image on the photosensitive drum by sequentially applying developer of a different colors to image forming portions of the latent image; a hole position sensor which senses when a hole in a transfer belt passes therethrough; and a transfer unit which sequentially receives each color of the latent image from the photosensitive drum and transfers the visible image from the photosensitive drum to a paper, the transfer unit including a transfer belt comprising a PC alloy portion having a throughhole proximate to an edge which is sensible by the hole position sensor, protective tape attached to upper and lower sides of both edges of the PC alloy, and an error protection section insertable into the throughhole and having a thickness substantially equal to the PC alloy proximate to the throughhole.

According to yet another aspect of the present invention, there is provided an image transfer belt for use in an image forming apparatus including an initial printing position determining unit. The image transfer belt includes: a loop of PC alloy having a throughhole near an edge; protective tape covering both upper and lower sides of both edges of the PC alloy loop; and an error protection section insertable into the throughhole and substantially the same thickness as the loop of PC alloy, the error protection section sensible by a hole position sensor which outputs a signal usable to determine an initial printing position, and preventing the protection tape from sticking together.

According to still another aspect of the present invention, there is provided a method of determining an initial printing position of an image transfer belt in an image forming apparatus so as to determine when an electrostatic latent image should be formed on a photosensitive drum so as to synchronize the latent image with the image transfer belt to prevent color imbalance between sequentially transferred colors of the latent image transferred from the photosensitive drum to the image transfer belt. The method comprises: driving at least a portion of the image transfer belt having an error prevention section through a position sensor; sensing the error prevention section via the position sensor; and outputting a signal indicating that the error prevention section is present in the sensor. The signal indicates the position of the image transfer belt and is used as at least a criterion to determine when the latent image should be formed on the photosensitive drum.

According to yet another aspect of the present invention, there is provided a transfer belt including: a PC alloy portion having a position sensing throughhole disposed near an edge of the PC alloy portion; protective tape attached to upper and lower sides of first and second edges of the PC alloy portion; and an error prevention section disposed in the position sensing hole and having a thickness substantially equivalent to that of the PC alloy portion surrounding the error prevention section.

According to yet another aspect of the present invention, there is provided an error prevention section of a transfer belt, the error prevention section including: a transparent portion through which a sensing signal is at least substantially unblocked; and an opaque portion through which a sensing signal is of least partially blocked. The transparent and opaque portions are arranged in a pattern which yields a signal when a position signal is passed through the error prevention section.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
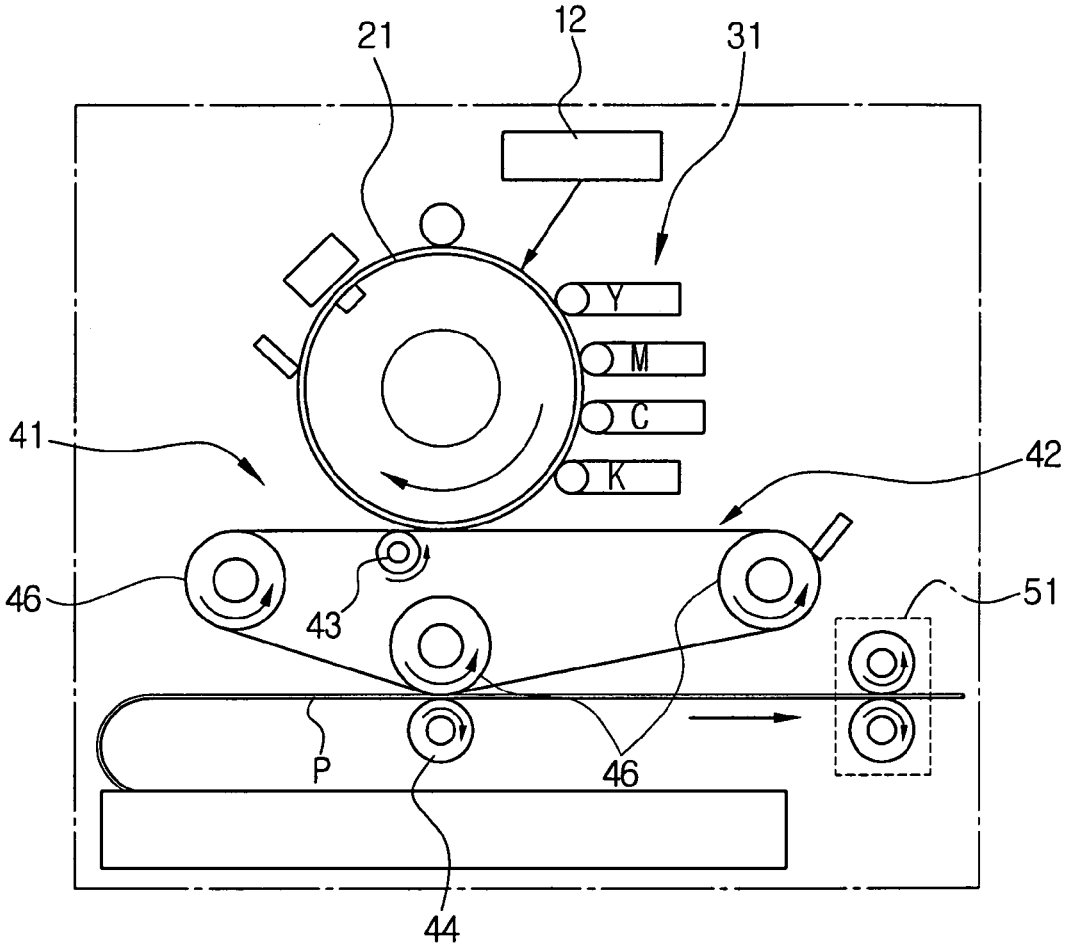
FIG. 1 (PRIOR ART)
FIG. 1 is a schematic cross-sectional view of the configuration of a typical image forming apparatus.
Figure 2:
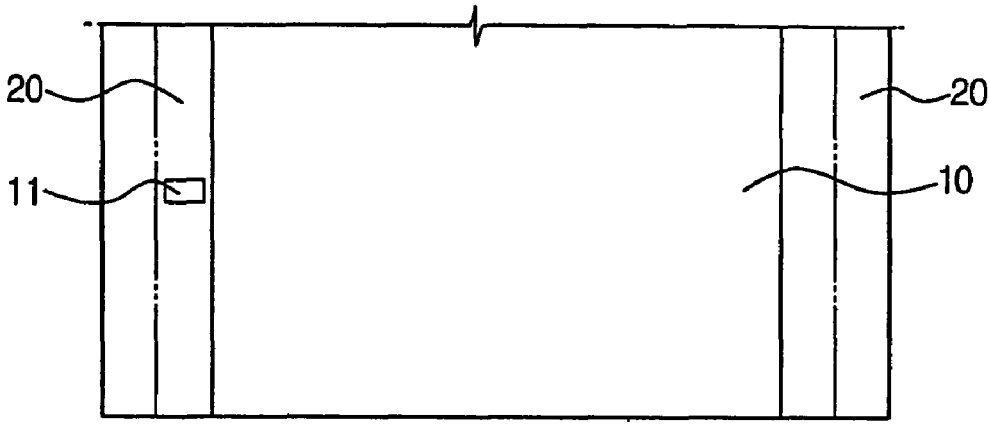
FIG. 2 (PRIOR ART)
FIG. 2 is a schematic elevation of the transfer belt of the image forming apparatus shown in FIG. 1.
Figure 3:
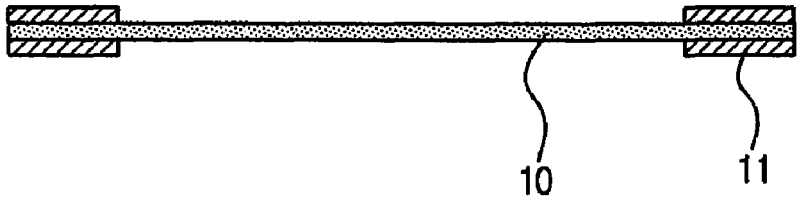
FIG. 3 (PRIOR ART)
FIG. 3 is a cross-sectional view of of the transfer belt shown in FIG. 2.
Figure 4:
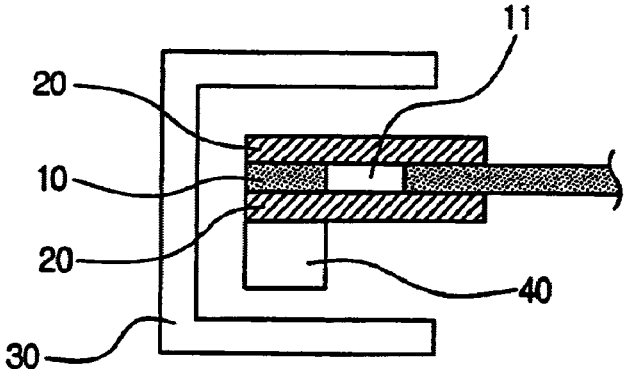
FIG. 4 (PRIOR ART)
FIG. 4 is a cross-sectional view showing a position sensor and a portion of the transfer belt shown in FIG. 3.
Figure 5:
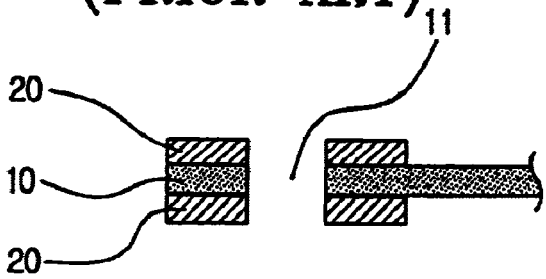
FIG. 5 (PRIOR ART)
FIG. 5 is a cross-sectional view showing another conventional transfer belt usable in the image forming apparatus shown in FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The above and/or other aspects, features and advantages of the present invention will be better understood from the following description taken in conjunction with the attached drawings.

Figure 6:
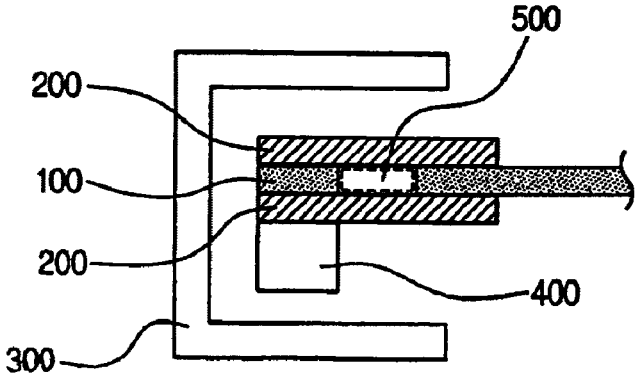
FIG. 6 is a schematic cross-sectional view of an intermediate transfer belt according to an embodiment of the present invention.
Figure 7:
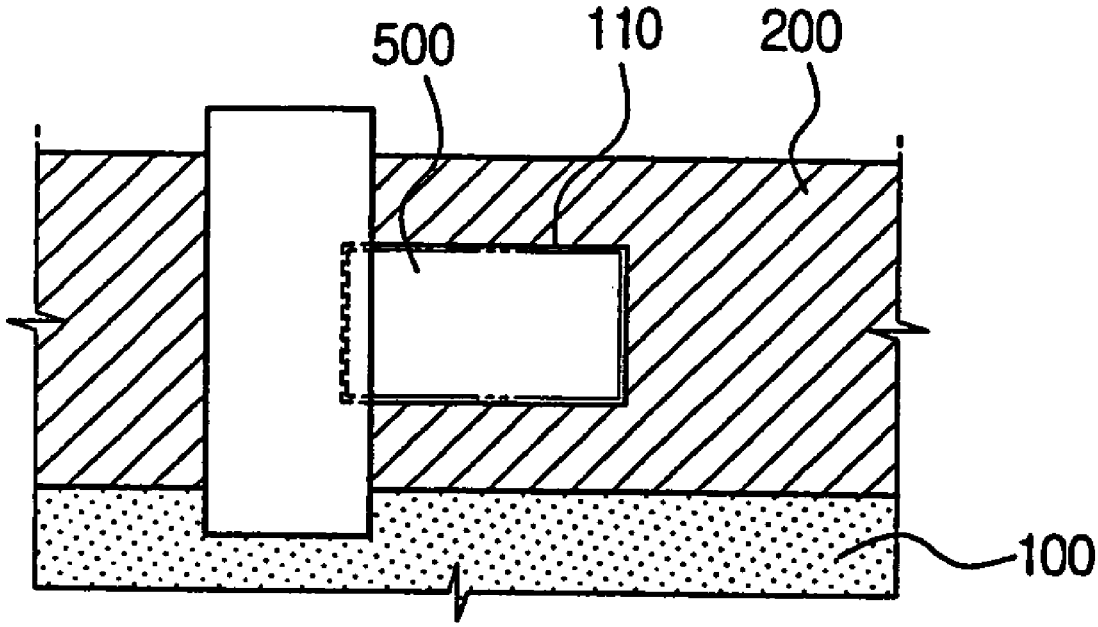
FIG. 7 is an elevation view of the intermediate transfer belt shown in FIG. 6.

FIG. 6 and FIG. 7 are a schematic cross-sectional view and an elevation view, respectively, showing a portion of the transfer belt according to an embodiment of the present invention passing through a position sensor. As shown, the transfer belt comprises a PC alloy 100, a position sensing hole 110 extending through the PC alloy 100, an error prevention section 500, and protective tape 200, and passes through the position sensor 300 while being supported by a guide rail 400.

The guide rail 400 is mainly formed of urethane rubber, and supports the transfer belt so as to prevent irregularities in the travel path of the transfer belt.

The position sensor 300 includes a transparent position sensor, and is disposed so that one edge of the PC alloy 100 can pass through it when the transfer belt is driven. The position sensor 300 senses when the position sensing hole 110 passes through it and outputs a signal indicating this condition. With this signal, the initial printing positions of each color may be determined.

The PC alloy 100 is an electric resistance body, and forms a composite color image by transferring the image from the photosensitive medium.

Turning to FIG. 7, the position sensing hole 110 is a transparent window or a throughhole sensible by the transparent position sensor. The position sensing hole 110 is a throughhole in the PC alloy 100, and the position sensing hole 110 is positioned so as to cause the position sensor to output a signal for determining the initial printing position.

The protective tape 200 is a transparent tape that is attached to protect both edge of the PC alloy 100, (the conductor of the transfer belt) and the position sensing hole 110. The protective tape 200 is attached to the upper sides and the lower sides at both edges of the PC alloy 100. The protective tape 200 is attached to the error prevention section 500 in the position sensing hole 110.

The error protection section 500 is formed so as to have a thickness equal to the PC alloy 100 around the position sensing hole 110. The error protection section 500 is formed of a transparent sheet, such as transparent PC. The error protection section 500 may be formed of patterns including various combinations of at least one opaque section at least one transparent section which may signal the position sensor 300 to transmit a signal. The error protection section 500 is inserted in the position sensing hole 110, and is attached to the protective tape 200 at the upper and lower sides. After attaching one of the upper or lower protective tapes 200 to the PC alloy 100, the error protection section 500 is attached to the protective tape 200 by inserting the error protection section 500 in the position sensing hole 110, and the other protective tape 200 is attached to the opposite side of the PC alloy 100.

Figure 8A:
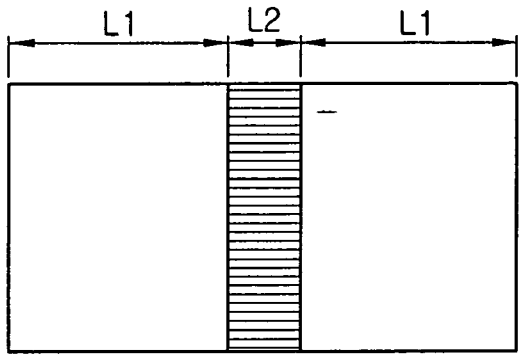
FIGS. 8A to 8C are schematic views of the alternate configurations of the position sensing hole of the intermediate transfer belt shown in FIG. 6.
Figure 8B:
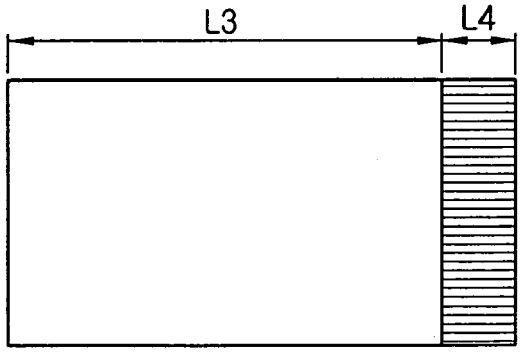
Figure 8C:
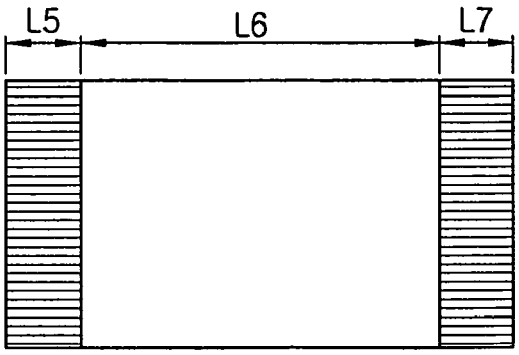
Figure 9A:
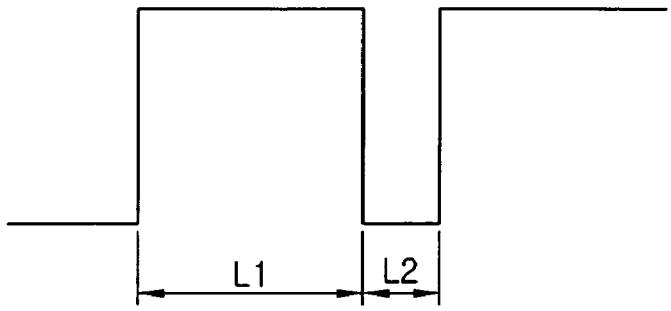
FIGS. 9A to 9C are graphs showing sensing signals output by a position sensor in response to the alternate configurations of the position sensing hole according to the embodiments of FIGS. 8A–8C.
Figure 9B:
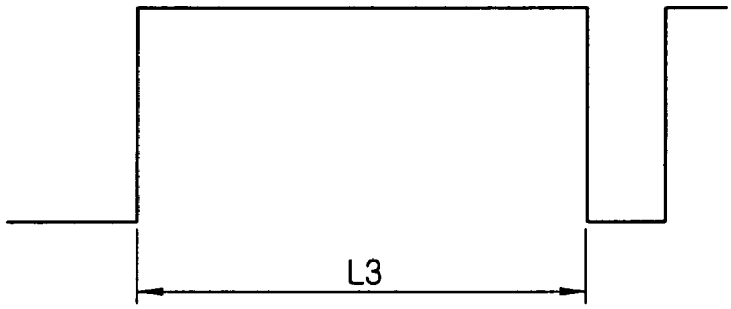
Figure 9C:
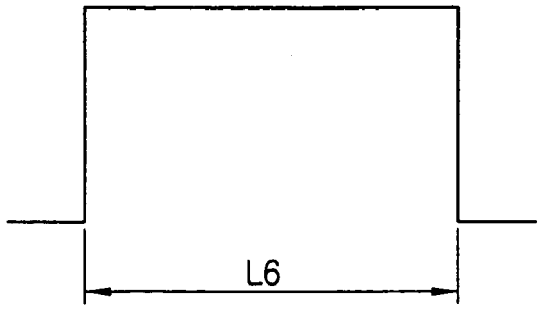

FIGS. 8A to 8C show alternative configurations of the error protection section 500, and FIGS. 9A to 9C are graphs showing a sensing signal that is transmitted according to the patterns of the error protection section 500 shown in the FIGS. 8A to 8C.

FIG. 8A shows the error protection section 500 having a pattern including non-transmitting section L2 located between transmitting sections L1. While the transmitting sections L1 pass through the position sensor 300, a sensing signal of the position sensor 300 is transmitted, thereby signaling the position of the position sensing hole 110. However, while the non-transmitting section L2 passes through the position sensor 300, the sensing signal is not output by the position sensor 300 as shown FIG. 9A. The output signal of the output sensor when the error protection section 500 has passed through the position sensor 300 is the same when the non-transmitting portion L2 of the error protection section 500 passes through the position sensor. Also, by way of a non-limiting example, if the point at which L2 ends is set as initial printing position, and if the position sensing signal is transmitted for L1 and is not transmitted for L2, then the point at which L2 ends may be considered the initial printing position.

FIG. 8B shows an alternative pattern configuration of the error protection section 500 according to another embodiment of the present invention. As shown in FIG. 8B, the error protection section 500 includes a transmitting section L3 and non-transmitting section L4. While the transmitting section L3 passes through the position sensor 300, the sensed signal corresponding to L3 is outputted as shown in FIG. 9B. However, as FIG. 9B also shows, while the non-transmitting section L2 passes through the position sensor 300, the sensing signal is not output by the position sensor 300. Also, by way of a non-limiting example, if the point at which L3 ends is set as initial printing position, then the instant at which the the sensed signal is suspended may be considered the initial printing position.

FIG. 8C shows another alternative pattern configuration of the error protection section 500 according to another embodiment of the present invention. The error protection section 500 is shown to have a pattern having non-transmitting sections L5 and L7 located before and after transmitting section L6. The sensed signal corresponding to L5 is outputted as shown in FIG. 9C. When the point at which L6 starts or ends is set as the initial printing position, the point at which the sensed signal corresponding to L6 starts or ends is determined as the initial printing position. In this configuration, by locating the non-transmitting sections L5 and L7 located before and after the transmitting section L6, definition of the transmitting section L6 may be improved, and the occurrence of error may be reduced.

As such, when the error protection section 500 is inserted in the position sensing hole 110 and then the protective tape 200 is attached to the upper and lower sides of the PC alloy 100, the protective tape 200 on the upper and lower sides is attached to the error protection section 500; not to each other.

Since the protective tape 200 is stably attached to the error protection section 500, the attachment portion of the protective tape 200 that is attached to the PC alloy 100 is not peeled-off. In other words, the gap formed when the PC alloy 100 has a thickness of 0.15 mm, the attachment between the segments of protective tape 200 in the section of the position sensing hole 110 is unstable, and the pores between the attached portions of the upper and lower protective tapes 200 that result in errors in the sensing operation of the position sensor 300 can be prevented. Additionally, in the case of using the protective tape 200 for a long time, it is possible to prevent the attachment portion of the protective tape 200 from detaching and peeling-off. Accordingly, it is possible to improve the accuracy of the sensing initial printing position and extending the lifetime of the intermediate transfer belt.

Although a few embodiments of the present invention have been shown and described, the present invention is not limited to the disclosed embodiments. Rather, it would be appreciated by those skilled in the art that changes and modifications may be made in this embodiment without departing from the principles and spirit of the invention, the scope of which is defined by the claims and their equivalents.

What is claimed is:

1. A transfer belt for use in an image forming apparatus that senses an initial printing position, comprising:

a PC alloy portion including a position sensing hole extending therethrough and disposed proximate to an edge of the PC alloy portion, the hole usable to determine an initial printing position;

protective tape attached to upper sides and lower sides of both edges of the PC alloy portion; and an error prevention section insertable into the position sensing hole and having a thickness substantially equivalent to the PC alloy located around the position sensing hole;

wherein the error prevention section comprises a transparent portion and an opaque portion having a pattern corresponding to a position sensing signal transmitted therethrough.

2. The transfer belt of claim 1, wherein the error prevention section comprises a transparent sheet.

3. The transfer belt of claim 1, wherein the error prevention comprises a pattern including a combination of at least one opaque portion through which a sensing signal is at least partially blocked and least one transparent portion.

4. The transfer belt of claim 3, wherein two transparent portions are adjacent to the at least one opaque portion.

5. The transfer belt of claim 3, wherein two opaque portions are adjacent to the at least one transparent portion.

6. The transfer belt of claim 3, wherein the combination is sensed by a position sensor which outputs a signal in response thereto.

7. The transfer belt of claim 1, wherein the protective tape is transparent.

8. The transfer belt of claim 1, wherein the protective tape is stably attached to the error prevention section as a result of the thickness of the error prevention section and the thickness of the PC alloy portion.

9. The transfer belt of claim 1, wherein the error prevention section is sensed and the apparatus uses the sensed result to determine the position of the transfer belt which is used to determine when an electrostatic latent image should be formed on a photosensitive medium to be sequentially transported to the transfer belt.

10. The transfer belt of claim 1, wherein the PC alloy portion is a loop.

11. An image forming apparatus comprising:

a photosensitive drum onto which a latent image is formable;

a developer unit which forms a visible image on the photosensitive drum by sequentially applying developer of different colors to the latent image;

a hole position sensor which senses when a hole in a transfer belt passes therethrough; and a transfer unit which sequentially receives each color of the latent image from the photosensitive drum and transfers the visible image from the photosensitive drum to a paper, the transfer unit including the transfer belt comprising a PC alloy portion having a throughhole proximate to an edge which is sensible by the hole position sensor, protective tape attached to upper and lower sides of both edges of the PC alloy, and an error protection section insertable into the throughhole and having a thickness substantially equal to the PC alloy proximate to the throughhole;

wherein the error prevention section comprises a transparent portion and an opaque portion having a pattern corresponding to a position sensing signal transmitted therethrough.

12. An image transfer belt for use in an image forming apparatus including an initial printing position determining unit, the image transfer belt comprising:

a loop of PC alloy having a throughhole near an edge;

protective tape covering both upper and lower sides of both edges of the PC alloy loop; and an error protection section insertable into the throughhole and substantially the same thickness as the loop of PC alloy, the error protection section sensible by a hole position sensor which outputs a signal usable to determine an initial printing position, and preventing the protection tape from sticking together;

wherein the error prevention section comprises a transparent portion and an opaque portion having a pattern corresponding to a position sensing signal transmitted therethrough.

13. A method of determining an initial printing position of an image transfer belt in an image forming apparatus so as to determine when an electrostatic latent image should be formed on a photosensitive drum so as to synchronize the latent image with the image transfer belt to prevent color imbalance between sequentially transferred colors of the latent image transferred from the photosensitive drum to the image transfer belt, comprising:

providing an error prevention section comprising a transparent portion and an opaque portion having a pattern corresponding to a position sensing signal transmitted therethrough, yielding a signal when the position signal is passed through the error prevention section, being insertable into a position sensing hole, and having a thickness substantially equivalent to a PC alloy portion located around the position sensing hole;

driving at least a portion of the image transfer belt having the error prevention section through a position sensor;

sensing the error prevention section via the position sensor; and outputting a signal indicating that the error prevention section is present in the sensor, wherein the signal indicates the position of the image transfer belt and is used as at least a criterion to determine when the latent image should be formed on the photosensitive drum.

14. A transfer belt comprising:

a PC alloy portion having a position sensing throughhole disposed near an edge of the PC alloy portion;

protective tape attached to upper and lower sides of first and second edges of the PC alloy portion; and an error prevention section disposed in the position sensing throughhole and having a thickness substantially equivalent to that of the PC alloy portion surrounding the error prevention section, wherein the error prevention section comprises a transparent portion and an opaque portion having a pattern corresponding to a position sensing signal transmitted therethrough.

* * * * *

UNITED STATES PATENT AND TRADEMARK OFFICE

CERTIFICATE OF CORRECTION

PATENT NO. : 7,123,870 B2
APPLICATION NO. : 10/706955
DATED : October 17, 2006
INVENTOR(S) : Myung-ho Kyung et al.

It is certified that error appears in the above-identified patent and that said Letters Patent is hereby corrected as shown below:

On the title page item (57), (Abstract), Line 1, change “An” to --A--.

Column 7, Line 4, change “hole;” to --hole,--.

Column 7, Line 14, change “least” to --at least--.

Column 7, Line 54, change “throughhole;” to --throughhole,--.

Column 8, Line 12, change “together;” to --together,--.

Signed and Sealed this

Sixth Day of March, 2007

JON W. DUDAS
*Director of the United States Patent and Trademark Office*